United States Patent [19]

Lloyd

[11] Patent Number: 4,927,024

[45] Date of Patent: May 22, 1990

[54] TRAY FOR A BABY'S CHAIR

[76] Inventor: Paul M. J. M. T. Lloyd, 8351 Gilbert Road, Richmond, B.C., Canada, V7C 1W4

[21] Appl. No.: 305,227

[22] Filed: Jan. 31, 1989

[51] Int. Cl.[5] ..... B65D 1/34

[52] U.S. Cl. ..... 206/562; 220/23.86

[58] Field of Search ..... 206/562, 563, 564; 220/22, 23.86

[56] References Cited

U.S. PATENT DOCUMENTS

| | | | |
|---|---|---|---|
| 855,565 | 6/1907 | Greenhouse | 206/562 |
| 3,499,595 | 3/1970 | Brooks | 206/563 |
| 4,068,760 | 1/1978 | Johnson, Jr. | 206/563 |
| 4,494,654 | 1/1985 | Gunther et al. | 206/562 |
| 4,533,051 | 8/1985 | Fleming | 206/563 |

*Primary Examiner*—Joseph Man-Fu Moy

*Attorney, Agent, or Firm*—Townsend and Townsend

[57] ABSTRACT

A tray for a baby's chair. There is a main body to attach to a baby's chair with at least one opening in the main body. A bowl having a open top is received in the main body with the open top aligned with the opening in the main body. There is a lid for the bowl and the opening. The tray can be carried on a flat surface or with a food bowl in place. The bowl cannot be pushed off the tray.

6 Claims, 3 Drawing Sheets

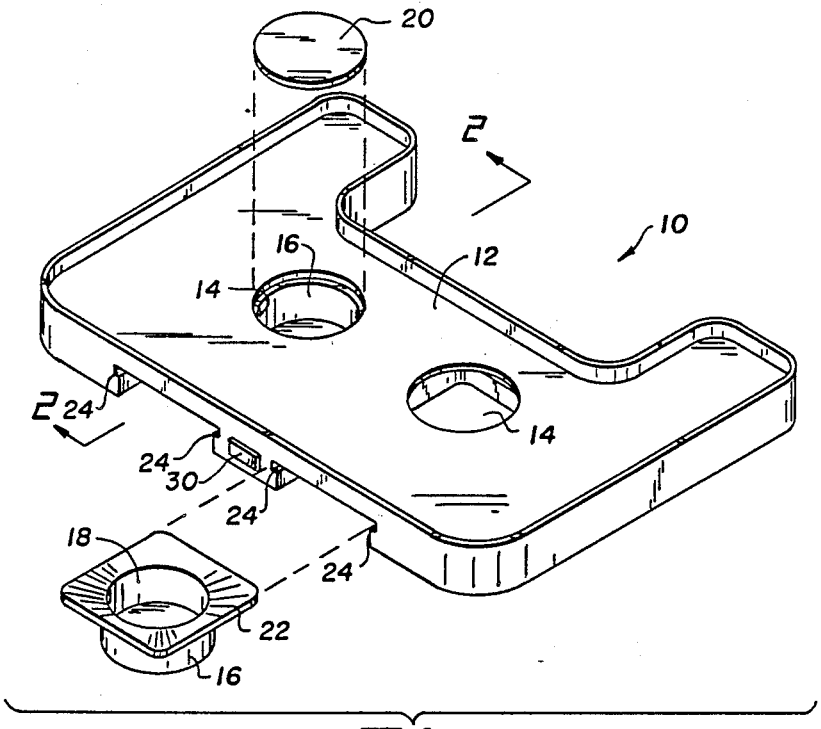
Fig. 1.
Fig. 2.
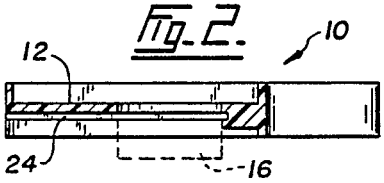
Fig. 3.
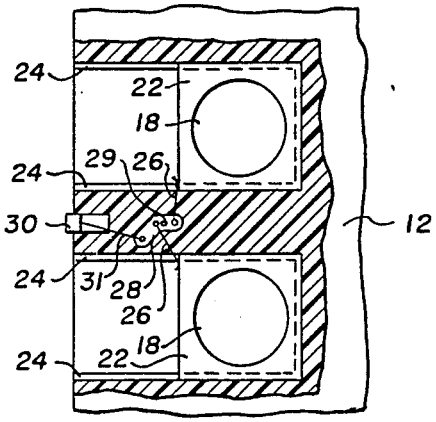

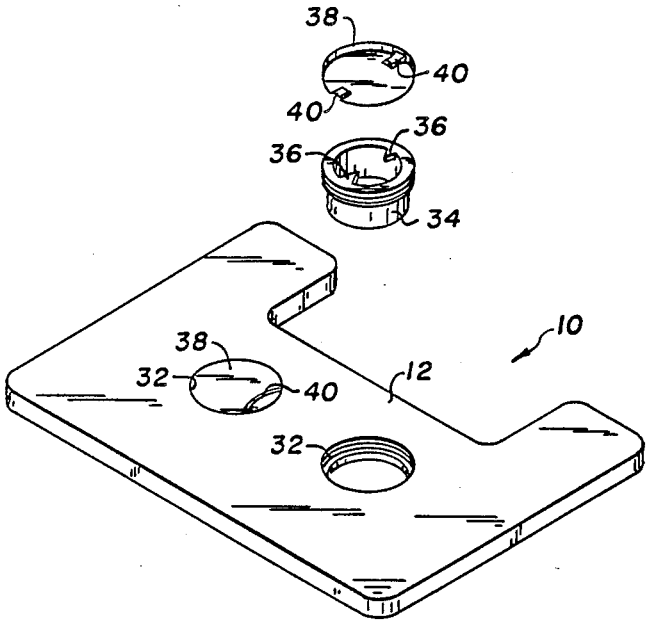
Fig. 4.
Fig. 5.
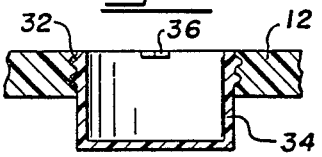

TRAY FOR A BABY'S CHAIR

FIELD OF THE INVENTION

This invention relates to a tray for a baby's chair.

DESCRIPTION OF THE PRIOR ART

A young child can be kept from wandering by placing the child in a high chair. The chair is high so the baby is at a height where it can be attended easily and the tray is used to keep the child in the chair and to provide a surface to place toys for the child or food at mealtimes. Typically the tray is a flat surface, often with a raised periphery, that can be removed or pivoted out of the way to allow removal of the child from the chair.

As anyone who has fed a baby in a high chair would testify, the sweeping away of the food by the child can be a, problem. Any child appears to delight in dropping articles from the high chair and, in particular, in pushing articles off the chair and with food the attendant mess compounds the problem.

The raised periphery on the tray is intended to reduce the problem but in fact often makes it worse. The raised periphery can simply be a means of ensuring that any dish that is swept off the tray by the child turns over as its base contacts the raised periphery.

There is thus clearly a need for a baby's tray in which at least food can not be swept off the tray by the baby but this provision must be compatible with the provision of a surface that is flat and uninterrupted.

SUMMARY OF THE INVENTION

The present invention provides a tray for a baby's chair that meets this need.

Accordingly, the present invention is a tray for a baby's chair comprising:

a main body adapted to attach to a baby's chair;

at least one opening in the main body;

a bowl having a open top to be received in the main body with the open top aligned with the opening in the main body; and a lid to close the bowl and the opening.

If necessary the tray may include a raised lip at its periphery but clearly it is less important with the tray of the present invention than with prior art trays.

Preferably, the tray has a pair of openings.

DESCRIPTION OF THE DRAWINGS

Aspects of the invention are illustrated, merely by way of example, in the accompanying drawings in which:

FIG. 1 is a perspective view, partially exploded, of one tray according to the present invention;

FIG. 2 is a section on the line 2—2 in FIG. 1;

FIG. 3 is a detail, in plan, of FIG. 1;

FIG. 4 is a side perspective view of a further embodiment of the present invention, again partially exploded;

FIG. 5 is a detail of FIG. 4;

DESCRIPTION OF THE PREFERRED EMBODIMENTS

Figure 6:
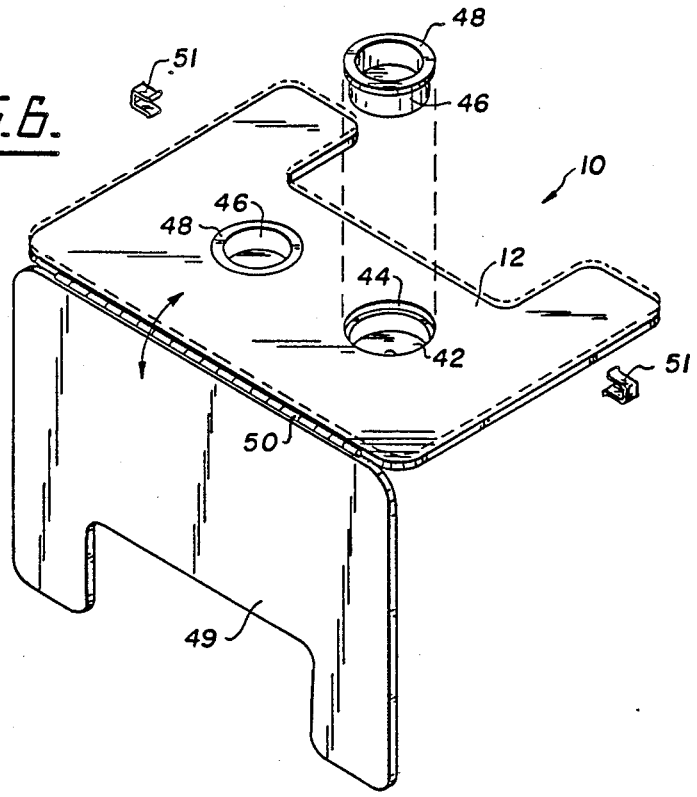
FIG. 6 is a perspective view, partially exploded, of a further embodiments of the present invention.

The drawings show a tray 10 for a baby's chair. The baby's chair is not shown in any of the drawings but the tray may be attached by conventional means to the baby's chair. It may, in certain circumstances, form a permanent part of the chair but, preferably, it is arranged so that it can be clipped on the arms of the baby chair or hinged at one side so that it can be pivoted out of the way to allow removal of the child from the tray.

The chair comprises a main body 12 with at least one opening 14 formed in it. A bowl 16 having an open top 18 is received in the main body 12. The bowl 16 is received in such a way that the open top 18 aligns with the opening 14 in the main body 12. There is a lid 20 to close the bowl 16 and the opening 14. In the embodiment of FIG. 1 the lid 20 is received in the main body 12 on the bowl 16, and is easily removed, when a bowl 16 is not in place, by pressure applied from underneath.

In the embodiment of FIGS. 1 to 3 the bowl 16 is formed with a flange 22. Channels 24 are formed on the underside of the main body 12 as shown particularly in FIGS. 1 and 2, to receive the flange 22. The channels 24 are open at their outer ends and closed at the inner end as shown in FIG. 1. This ensures first that a bowl 16 may be moved along a track formed by the channels 24 to align with an opening 14 of the main body 12. But abutment of the flange 22 with the end of the track also ensures correct alignment of a bowl 16 with an opening 14.

There are locking means to ensure that a bowl 16, or a pair of bowls 16, are maintained with their open tops 18 aligned with the openings 14 in the main body 12. As shown particularly in FIG. 3 the locking means comprise catches 26, urged outwardly and inwardly by bell crank 28 to abut an edge of the flange 22 of a bowl 16. The bell crank 28 pivots at 29 and a control wire 31 extends from crank 28 to knob 30. To retract or extend the catches 26 the knob 30 is moved.

Thus to use the embodiment of FIGS. 1 to 3 to hold food for the baby, first the lids 20 are pressed upwardly, out of the body 12. Knob 30 is moved outwardly to retract catches 26. The flanged bowl 16 is then moved along channels 24 until the end abuts the end of the channels. When the tray is past the catches 26, as shown in FIG. 3, the knob 30 is moved inwardly to extend the catches 26 to retain the bowl 16 in position. When it is desired to remove the bowl 16, the button 30 is pulled, thus moving the catches 26 inwardly. The bowls 16 are removed and the lids 20 are replaced to provide a continuous surface for the main body 12.

In the embodiment of FIGS. 4 and 5 openings 32 in body 12 are threaded internally. There is a corresponding external thread on each bowl 34 to be received in an internal thread of an opening 32. Desirably the bowl 34 is provided with an internal projection 36 to facilitate turning to engage the threads. A lid 38 is provided and is desirably a press fit. If necessary, recesses 40 may be provided on the underside of the lid 38 to accommodate the projections 36. The lid 38 is also provided with an indent 40, as shown in FIG. 4, to allow gripping by hand of the lid 38 for removal.

Figure 7:
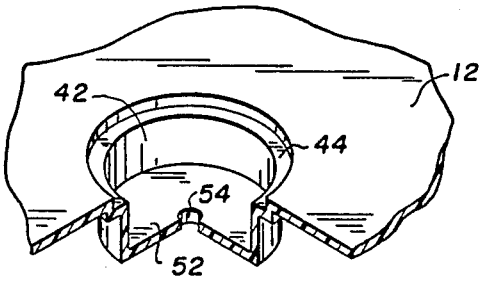
FIG. 7 is a detail of a FIG. 6.

In the embodiment of FIGS. 6 and 7 the main body 12 is formed with recesses 42 formed with a peripheral shoulder 44 at its top. Bowl 46 has a peripheral flange 48 to be received on the shoulder 44. The flange height is such that the upper surface of the bowl 46 can lie is flush with the upper surface of the main body 12. A flat closure member 49 is hingedly attached to the main body at 50 to provide a lid. Simple U-clamps 51 are provided to clamp the member 49 to the main body 12 to retain it in a closed position when the tray is not in use at meal times, for example to allow the baby to play with a toy on the tray. As shown particularly in FIG. 7 the tray is formed with indents 52 to receive the bowls 46. In this regard it would be appreciated that it is desirable to be able to remove the bowls 46 easily to facilitate washing without having to wash the whole tray after each meal. There is thus an opening 54 provided in the base of each recess 52 to allow the bowl 46 to be pushed upwardly for removal from the main body.

Stops may be provided on the underside of the tray to retain the tray vertical and thus out of contact with the baby's feet. The hinging at 50 may be replaced by simple L-catches that allow the closure member 49 to hinge but also allow easy removal of the closure member.

The tray of the present invention can be made of wood or of plastic. It is lightweight, easy to make and simple to use. It provides considerable advantages in the feeding of a small child, in particular it restricts the ability of the child to push a bowl full of food off the table and on to the floor.

I claim:

1. A tray for a chair comprising:

a main body adapted to attach to a chair;

at least one opening in the main body;

a bowl having an open top to be received in the main body with the open top aligned with the opening in the main body, the bowl being formed with a flange;

a track formed on the underside of the main body to receive the flange, whereby the bowl may be moved along the track to align with the opening in the main body; and a lid to close the bowl and the opening.

2. A tray as claimed in claim 1 including a raised lip at its periphery.

3. A tray as claimed in claim 1 having a pair of openings.

4. A tray as claimed in claim 1 in which the track is open at an end coincidental with the periphery of the main body and closed at its inner end, the position of the bowl being controlled by abutment of the flange with the closed end of the track.

5. A tray as claimed in claim 4 including locking means to maintain the bowl open top aligned with the opening in the main body.

6. A tray as claimed in claim 5 in which the locking means comprises a catch that can be moved to abut an edge of the bowl to keep the bowl in position; and means to extend and retract the catch to allow location or removal of the tray.

* * * * *